United States Patent [19]

Rose, Jr.

[11] Patent Number: 4,798,032

[45] Date of Patent: Jan. 17, 1989

[54] DOMICAL STRUCTURE AND METHOD FOR ITS MANUFACTURE

[75] Inventor: Benjamin L. Rose, Jr., Richmond, Va.

[73] Assignee: American Geodesics, Inc., Richmond, Va.

[21] Appl. No.: 158,709

[22] Filed: Feb. 22, 1988

[51] Int. Cl.[4] ..... E04B 1/32

[52] U.S. Cl. ..... 52/81; 52/309.9; 52/747

[58] Field of Search ..... 52/80, 81, 86, 89, 309.9, 52/747

[56] References Cited

U.S. PATENT DOCUMENTS

| | | | |
|---|---|---|---|
| 2,918,992 | 12/1959 | Gelsavage . | |
| 2,978,074 | 4/1961 | Schmidt . | |
| 3,114,176 | 12/1963 | Miller | 52/81 |
| 3,296,755 | 1/1967 | Chisholm . | |
| 3,392,495 | 7/1968 | Ahern et al. . | |
| 3,530,621 | 9/1970 | Rutzebeck | 52/81 |
| 3,881,284 | 5/1975 | Martin . | |
| 3,925,940 | 12/1975 | O'Connell, Jr. et al. . | |
| 4,026,078 | 5/1977 | Ahern et al. . | |
| 4,092,810 | 6/1978 | Sumner . | |
| 4,241,550 | 12/1980 | Sumner . | |
| 4,287,690 | 9/1981 | Berger et al. . | |

*Primary Examiner*—Henry E. Raduazo

*Attorney, Agent, or Firm*—Staas & Halsey

[57] ABSTRACT

An improved domical structure is disclosed built from thirty identical flat isosceles triangular sections of expanded polystyrene which are further divided into two triangular subsections. The division is from either of the two equal sides of the section to the opposite apex which is bisected into two equal angles. This division creates sixty similar yet unidentical flat scalene triangular subsections of equal height as measured from the largest side which are interconnected by means of a spline joining arrangement in a manner that the dividing line of a triangular section never aligns with the dividing line of an adjacent triangular section thus making a stronger more self supporting shell both during and after construction. The structure is covered both on the inside and outside with a fiber reinforced cementitious structural coating.

8 Claims, 2 Drawing Sheets

DOMICAL STRUCTURE AND METHOD FOR ITS MANUFACTURE

This invention relates to a domical structure made from a plurality of flat triangular sections.

R. Buckminster Fuller and others (Dome Book II, 1971, by Pacific Domes) have described and popularized domes as building structures and described various possible geodesic breakdowns of the elements to make such domes.

The present invention describes an improvement to the inventor's earlier U.S. Pat. No. 4,287,690 which utilizes lightweight triangular panels with continuous edge tongues and grooves to construct a domical structure.

In order to make such a structure of substantial size the individual flat panels would be too large to be made from a single piece of material. For example, readily available material at present comes in eight inch thick sheets sixteen feet long by an untrimmed width of fifty inches. Normally, this is trimmed to forty-eight inches in width to eliminate the rough untrimmed edges. When the flat triangular sections of the prior U.S. Pat. No. 4,287,690 are made from two separate triangular subsections the dividing line between the subsections are weaker than the undivided material. The present invention provides for a domical structure made of flat triangular sections which are too large to be made from a single piece of available material and are too large for normal handling. The invention utilizes triangular sections which have been further divided into two unique triangular subsections that are easily handled during construction and can be uniquely arranged and joined together in a manner to minimize the weakness caused by the division.

The preferred embodiment is made from sixty of these triangular eight-inch thick expanded polystyrene subsections and sixty-nine expanded polystyrene splines to construct a geodesic dome with a hemispherical diameter of thirty feet and a center height of nineteen feet. This gives a first floor space of 500 square feet with up to 500 square feet of optional second floor space. The structure is extremely strong, energy efficient and easy to construct using an inside and outside skin of one quarter inch thick coat of a concrete plaster made from cement, masonry sand, synthetic latex and an open weave of fiberglass reinforcement with an additional synthetic elastomeric coating on the exterior for additional weatherproofing, finish, texture and color. One or more additional coats of material may be applied to the interior surface for extra fire resistance. The domical structure has three openings in the base which may be framed out with conventional wood framing techniques for windows and doors or to join multiple domes to each other.

The advantages of the invention will become apparent by reference to the following description including the accompanying drawings, in which.

Figure 1:
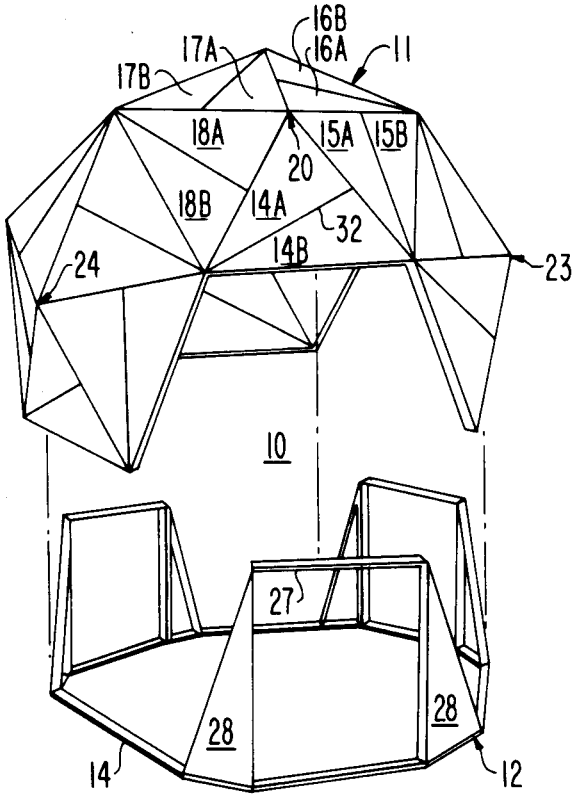
FIG. 1 is an exploded view of the domical structure showing the base and framed-in portion and the domical portion made from a plurality of triangular sections each of which is further divide to two triangular subsections.

With reference to FIG. 1 there is shown the domical structure 10 of this invention exploded into a domical part 11 and framed-in part 12. The domical part 11 is made of six pentagonal supersections or building modules, three of which are joined at the top to form the top substructure and three at the bottom form the base substructure. Each pentagon building module is made of five triangular sections and each of these are divided into two triangular subsections. With reference to FIG. 1 there can be seen the entire pentagon building module 20 as part of the top substructure but the remaining two building modules 21 and 22 are hidden in FIG. 1 but shown in FIG. 2.

For convenience of illustration the pentagon building modules are identified by their numbers with arrows pointing to the apex of the module.

The three pentagon building modules 20, 21 and 22 form the top substructure and the pentagon building modules 23, 24 and 25 form the base substructure. The entire module 24 can be seen in FIG. 1 and parts of modules 23 and 25 can also be seen. Parts of the three modules 23, 24 and 25 can be seen in FIG. 2.

Pentagon building module 20 has been further divided in FIG. 1 into flat triangular sections 14, 15, 16, 17 and 18 with each of the sections being further subdivided into flat triangular subsections **14*a*, 14*b*, 15*a*, 15*b*, 16*a*, 16*b*, 17*a*, 17*b*, 18*a*, 18*b***, respectively. Each of the other five pentagon building modules can be similarly divided.

Figure 2:
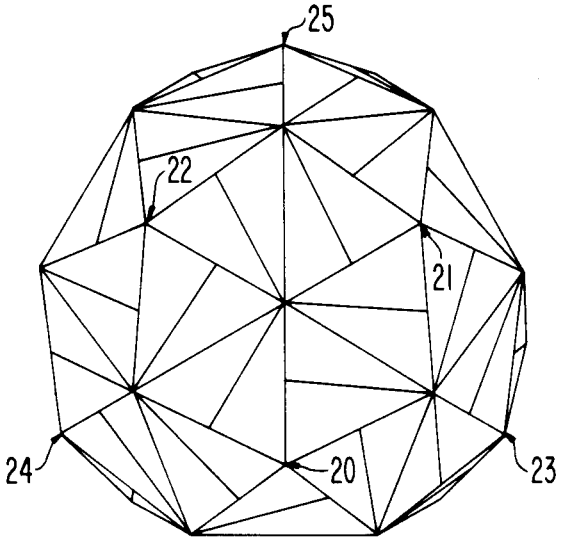
FIG. 2 is an overhead plan view of the domical structure.
Figure 4:
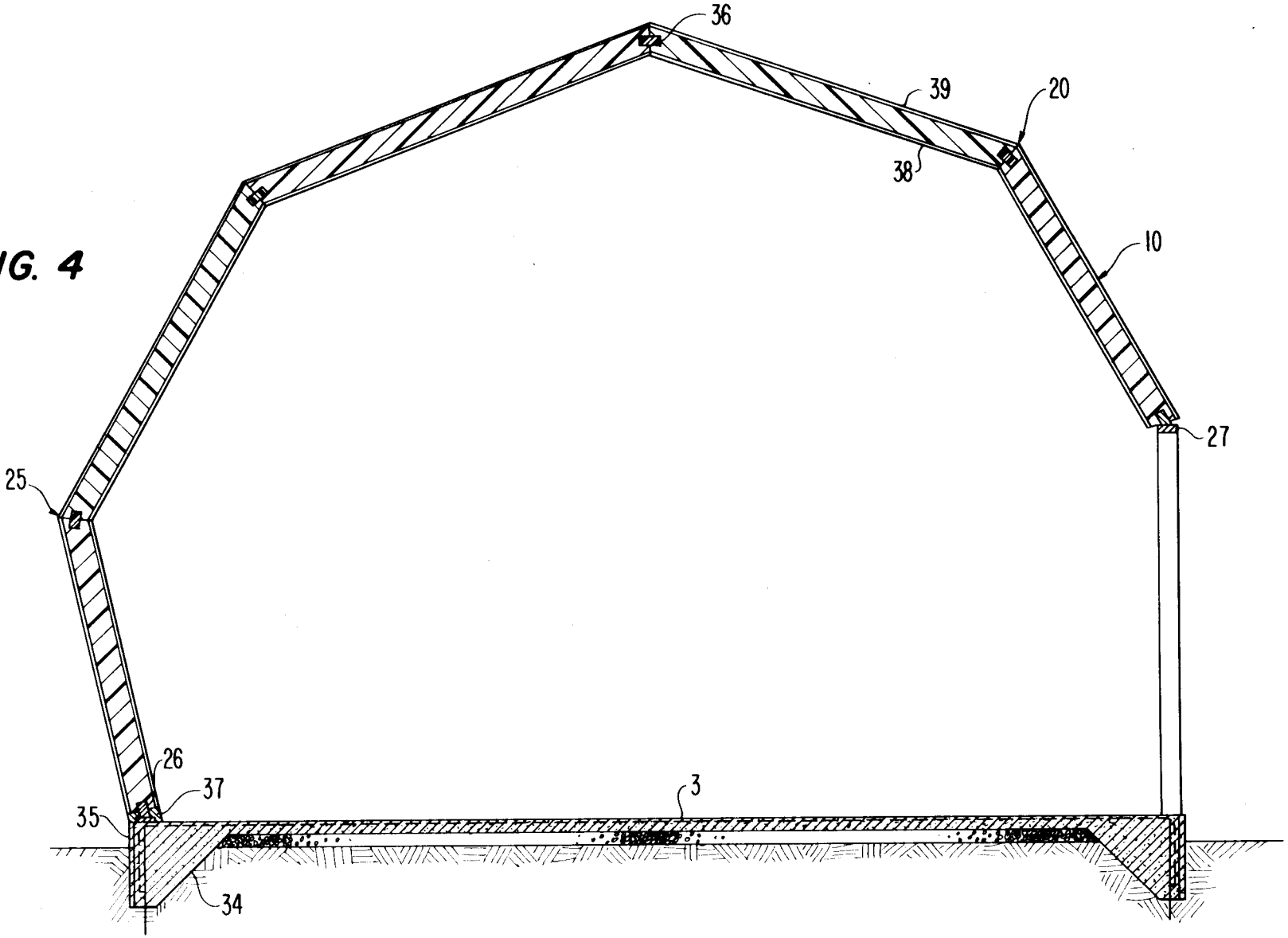
FIG. 4 is a cross-sectional view of the completed domical structure.

The framed-in part 12 of FIG. 2 fills the openings between the three pentagon building modules forming the base. The framed-in part 12 has a wood keyway end plate 14 surrounding the periphery of the structure and bolted onto a concrete slab as shown in FIG. 4. Over each of the three openings there is a wood header 27 and each of the three openings as shown are enclosed by two plywood panels 28 which surround a rectangular opening. The opening is adapted to be enclosed either by windows, doors or as a connector to other structures to form a cluster of structures.

Figure 3:
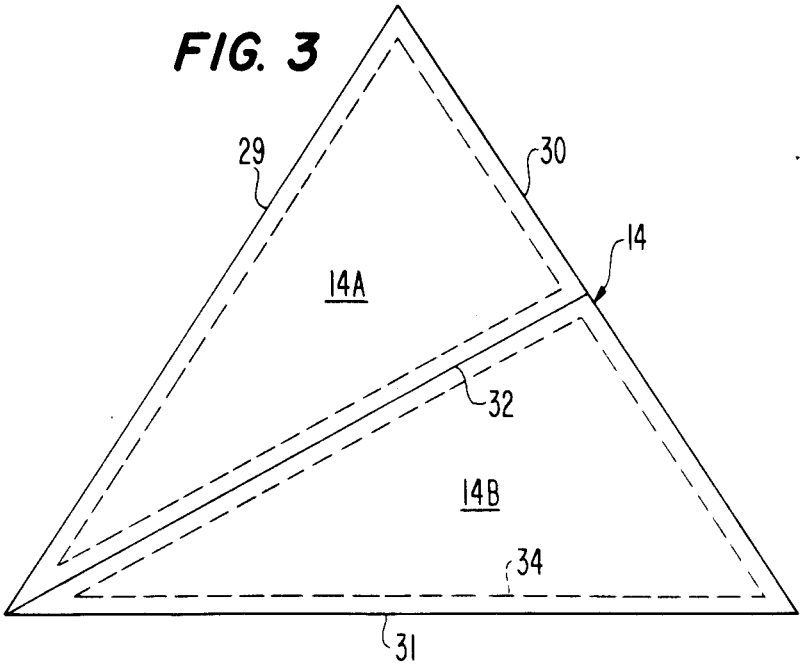
FIG. 3 is a view showing a triangular section subdivided into two triangular subsections.

With reference to FIG. 3 there is shown a isosceles triangular section 14 as viewed from the exterior. The two equal sides 29 and 30 are nine feet six and one-quarter inches and the long side 31 is ten feet seven and one-quarter inches for the thirty foot diameter dome.

The triangular section 14 is divided into two subsections **14*a* and 14*b*. The two subsections have a common face of the same length along the dividing line 32. The dividing line runs from the apex to a point of one of the equal but divided side 30. The point is chosen so that the two triangular subsections 14*a* and 14*b* each have the same height, which is fifty inches, as measured from longest side. This results in triangular subsection 14*a* having a short side of four feet six inches and triangular subsection 14*b*, the larger of the two subsections, having a short side of five feet and one-quarter inch. The dividing line 32** bisects the apex into two 28 degree angles.

The dotted line 34 surrounds each of the subsections and depicts a groove in the subsection into which a spline is inserted. The two equal sides 29 and 30 are bevelled inwardly at a 13 degree angle to permit their flush joinder with adjacent sections to form the pentagon building module 20. The long side 31 is bevelled inwardly at a 9 degree angle so as to permit flush joining with adjacent pentagon building modules.

Both subsection 14*a* and subsection 14*b* are cut from 8 inch thick foam polystyrene flat billets of fifty inch untrimmed width and sixteen feet long. Normally the billets are pretrimmed to eliminate the poor structure at the edges to forty-eight inches width. But with the bevels of thirteen or nine degrees along the untrimmed edge the bevelling operation trims off most of the poor surface leaving a maximum size triangle as shown in FIG. 3. The surplus foam material is cut into splines three inches thick by six inches wide to accommodate the grooves 31 which are at right angles to the bevelled edges three inches deep. There is no bevel to the edge along the dividing line 32 which is at right angles to the face of the subsections.

Thus, there are provided a triangular subsection 14*b* which approximately ten feet seven and one-quarter inches long by fifty inches wide and triangular subsection 14*a* which is nine feet six and one-quarter inches long by fifty inches wide both of which can be handled readily by hand in building the domical structure. The width or height is measured for each subsection perpendicular to the long side to its apex. However, there is a point of weakness along the dividing line 32 and this is especially a point of weakness where the dividing line meets divided side 30 as it has a tendency to bend and sag in that vicinity. To strengthen the section, rather than further weakening it, it is important to note in FIG. 1 that the dividing line 32 meets the adjacent triangular section 15 along an undivided side. The undivided side supports the section 14 from sagging and bending at the dividing line intersection.

Other divisions of the triangular flat section are possible but they must be done in the manner shown where a dividing line and its intersection in a flat section are supported by an undivided side of an adjacent flat section or, as a minimum, is not aligned with the dividing line of an adjacent section.

With reference to FIG. 4, there is shown a cross-section of the domical structure 10 with the cross-section going through one of the three openings and dividing the structure. The foundation is a four inch slab of concrete 33 placed on four inches of a compacted stone base. The concrete is suitably reinforced with steel mesh and steel rods and is surrounded by a concrete foundation 34 which extends below the frost line. The periphery of the foundation is surrounded by a one inch thick layer of insulation 35 which is glued to the concrete and covered over by a coating of a Cemix (Trademark) concrete plaster. The Cemix is available from American Geodesics, Inc., 1505 Webster Street, Richmond, VA 23220 and is a proprietary water acrylic latex modifier which is used by mixing with Portland cement and masonry sand. It is usually reinforced with woven fiberglass reinforcement. Other water latex and equivalent coatings are readily available which bond with the polystyrene foam.

Bolted to the top of the concrete slab 33 around its periphery is a wood keyway and plate 26. This serves as a substitute for the spline to connect said triangular sections around the foundation. Likewise above the opening there is a wood header 27 and jambs along the sides. The header serves in place of a spline to connect with other triangular sections.

The groove three inches deep surrounding the triangular sections is cemented to the wood keyway and plate 26 and likewise to the wood header 27 as the domical structure is built from the foundation upwards. The cement used is an acrylic latex adhesive, contact cement available from DAP Inc., Dayton, Ohio 45401 and there are a number of other adhesives available to do the same job. The same adhesive is used in all of the spline joints.

It is to be noted that there is a space 37 between the triangular section and wood keyway and plate 26. This is filled in by a filler made from cut scrap foam or the adhesive. The spline joint 36 is located between the sides of each of the triangular subsections where they meet the adjacent subsections. The spline is made from the polystyrene foam sheets so as to be three inches high, six inches wide and as long as needed for each joint. The groove made in the eight inch thick polystyrene foam flat triangular subsections is three inches wide and approximately three inches deep.

It is to be noted in FIG. 4 that the cross-section only shows the joints between triangular sections and the joints between the triangular subsections are omitted but such joints are identical with the exception that no bevels are present.

The method of constructing the domical structure is to first cut the appropriate number of triangular subsections and splines from a fifty inch unfinished width by eight inch thick by sixteen foot long foam polystyrene billet of a density of approximately 1.25 pounds per cubic foot. This requires sixty triangular subsections and sixty-nine splines. While splines and grooves are used in the preferred embodiment, a tongue and groove or similar joint may also be used.

A concrete slab 33 with a concrete foundation 34 and peripheral insulation is prepared and laid down as shown in FIG. 4. Other foundations such as a wood deck may also be used. To this foundation and its periphery is bolted the base plate including the wood keyway and plate 26. To the base plate are attached the plywood panels 28 and the upright jambs on each side of the three openings which are joined at their top by wood header 27. Three wood keyway and plates 26 have tongues angling outwardly to act as splines which are inserted into the grooves of the subsections. Other base pieces have tongues perpendicular to the plate and serve as the uprights on both sides of the three doorway openings to which the plywood panels 28 are attached. The three wood headers 27 which run across the top of the openings have tongues angled inwardly to serve as splines for the subsections to which they are attached.

The foam material which is utilized in making the triangular subsections is preferably polystyrene with density varying from approximately one to three pounds per cubic foot, but other materials and other densities may be used.

The wood base and three ten by nine feet doorway openings forming the framed-in part 12 of the domical structure acts as a guide for the proper placement of the first row of prefabricated foam panels which have been pregrooved after being cut from the slab. Starting at the base the triangular subsections are driven onto the spline-like uprights of the base by a wooden hammer applying beforehand a suitable adhesive to the joint. The structure is gradually built up subsection by subsection by joining subsections to each other using splines and adhesive until the last panel at the top is to be inserted. The last triangular subsection panel has the inside edge of its groove removed so the last panel can be simply dropped in place from the exterior. Afterwards the inside groove edge is adhesively placed back onto the panel to complete the foam shell. Any cracks or openings in the shell are filled in.

Next an interior cementitious skin 38 is applied approximately one quarter inch in thickness using the CEMIX (Trademark) concrete plaster using the Cemix latex modifier with a blend of Portland cement and masonry sand. This interior coat is applied using a first coat of approximately one-eighth inch with conventional plastering techniques. Then overlapping sheets of open weave fiberglass fabric of a density of 3.97 OSY is imbedded in the first coat. Then a second one eighth inch thick coating of the Cemix concrete plaster is applied over the fiberglass reinforcement. Other reinforcement material may also be used as a substitute or supplement if desired. The interior coat is applied from scaffolding in the dome interior. Once the inside coat is set sufficiently the outside may be walked on while applying a similar exterior coat 39. The inside coat 38 and exterior coat 39 complete the structural integrity of the domical structure.

A synthetic elastomeric coating, a number of which are readily available, is finally applied to the exterior for additional weather-proofing, finish, texture and color. One or more additional coats of the Cemix blend or other materials may be applied to the interior surface for extra fire resistance.

The three doorway openings in the base may be framed out with conventional wood framing techniques to whatever size windows and doors desired. They can also serve as connection points for custom extensions or multiple dome configurations and also serve as load bearing walls for the full or partial second floor. Interior walls may be placed wherever desired. Skylights and roof windows ma be installed in any of the triangular sections as desired. The shell with only the edge groove and splining system and accompanying base is strong enough not only to be self supporting during construction but also can support the weight of the wet reinforced interior plaster and reinforcing material until it cures. By applying the interior cementitious skin first and allowing several days for it to reach initial cure the still unfinished structure is able to support the weight of several people as they then apply the exterior cementitious coating 39.

A residence is currently under construction using two of the domical structures connected together with a ducted radiant floor slab to store both solar heat and heat given off by a central living room fireplace. One dome has a fireplace and an open great room with only a "TV loft" leaving the rest of the space open to the nineteen foot tall cathedral ceiling. The adjacent dome combines a kitchen, dining room and a half bath on the first floor and two bedrooms and a full bath upstairs.

There is thus provided a domical structure covering the same amount of space as a rectangular structure with one third less material. It is of roughly spherical shape and is one of the strongest, energy efficient and most aesthetically pleasing shapes in nature. The triangular subsections and triangular sections are the basis for the geodesic dome construction to provide one of the strongest geometric forms. The domical structure is a monolithic structure with a continuous interior and exterior coating and insulating core. There are no cracks for heat to leak out or air or water to leak in. The imbedded fiberglass reinforcement provides extra impact tensile and flexual strength. It is applied over both the interior and exterior. The spline jointing as described above of the triangular subsections simplifies construction and eliminates the need for a complicated framing system. The seamless reinforced concrete plaster forms a long lasting weather-proof structural coating in a variety of maintenance free colors and textures.

The unique division of the triangular sections into two subsections make them easier to handle manually and largely eliminates the problem of structural rigidity that would otherwise cause sagging and weakness by ending the dividing line of the triangular sections preferably along one of the short and equal sides of the isosceles triangle and arranging for the dividing line to abut up against the short side of an adjacent triangular subsection which has not been divided. The thermal resistance of the lightweight foam core panels is R-32+ which provides a structure having a minimal heating and cooling cost.

While a specific structure has been shown, numerous variations can be made as to the sizes and arrangements of the panels and still utilize the concepts of the invention. The invention can be used for other purposes than residential housing and adapted to such uses as required. Therefore the foregoing is considered as illustrative only of the principles of the invention. Further, numerous modifications and changes will readily occur to those skilled in the art, and it is not desired to limit the invention to the exact construction and operation shown and described and accordingly all suitable modifications and equivalents may be resorted to falling within the scope of the invention as claimed herein.

What is claimed is:

1. A domical structure made principally from a multiplicity of substantially flat triangular sections coming together at edges comprising: first and second substantially flat triangular subsections joined together along a dividing line to form each of said triangular sections with said dividing line running from an apex of said triangular section to an opposite divided side thereof; each of said first and second triangular subsections having a first and longer side forming one side of said triangular section, a second side of intermediate length which is the same length in both subsections and define the side where the two subsections are joined together and a third and shorter side which forms part of said third divided side of the triangular section; and said sections third divided side arranged in the structure so that no dividing line throughout the entire structure is positioned to be aligned with another dividing line of an adjacent section at an edge between the adjacent sections.

2. The domical structure of claim 1 wherein said triangular section is a triangle having two sides of equal length and a third side of longer length where said dividing line divides said sections and runs from one of said equal sides to the opposite apex to divide said apex into two equal angles and to divide said section into the two said subsections wherein the heights of each subsection as measured from their first and longer side are equal with said other equal length side undivided; and wherein said section is arranged in the structure so that said divided side is adjacent an undivided equal length side of an adjacent section.

3. The domical structure of claim 2 wherein said section is made of thick foam plastic, said equal length sides of said section are bevelled inwardly at an angle of approximately thirteen degrees and said longer side is bevelled inwardly at an angle of approximately nine degrees.

4. The domical structure of claim 3 wherein each of said subsections has a groove about its entire periphery and includes a spline of foam plastic of the same width and twice the depth of said groove adhesively bonded in the groove of one subsection and its adjacent subsection to form a permanent spline and groove joint.

5. The domical structure of claim 4 wherein five of said triangular sections are joined together along their equal length sides to form a pentagon building module.

6. The domical structure of claim 5 wherein three of said pentagon building modules are joined together along the longer side of the triangular sections making up the module to form the top substructure of said domical structure and a second set of three of said pentagon building modules being joined to said top substructure along two adjacent peripheral sides and joined to the foundation of said domical structure along a third and opposite side.

7. The domical structure of claim 6 wherein said inside of said structure is coated with a reinforced cementitious layer and said outside is coated with a reinforced cementitious layer.

8. A method for fabricating a domical structure comprising the following steps:

provide a foundation for said structure; provide a peripheral connector, fastened to the periphery of said foundation;

provide three equally spaced headers and jambs to define openings around a periphery of said foundation;

provide sixty suitably sized substantially triangular subsections with thirty subsections of a first size and thirty subsections of a slightly larger second size of thick expanded foam having peripheral grooves, each subsection having a long side, an intermediate length side with the intermediate sides of all sixty subsections the same length and a short side with said short side of the smaller subsection plus said short side of the larger subsection equalling the length of said long side of said first sized subsection;

connect the long side of a larger subsection to the foundation connector between the structure defining the openings;

join to the intermediate side of said foundation subsection the intermediate side of a smaller subsection along a dividing line so that the pair of small and large subsections make a flat triangular foundation section;

join the long side of another small subsection across the two small sides of the subsections of the foundation section;

proceed to join the remaining subsections in a similar manner by bridging and joining the two small sides of paired subsections in a section by the long side of an adjacent small subsection and by joining the long sides of the large subsections with the long side of adjacent large subsection to complete the shell of said domical structure so that no dividing line along the intermediate sides between two adjacent subsections throughout the entire structure is positioned to be aligned with another dividing line of an adjacent section of an edge between adjacent sections;

apply a reinforced cementitious structural coating to the inside of said shell;

permit said inside coating to harden; and apply a reinforced cementitious structural coating to the outside of said shell.

* * * * *